US007965857B2

(12) United States Patent
De Haan

(10) Patent No.: US 7,965,857 B2
(45) Date of Patent: Jun. 21, 2011

(54) LOUDSPEAKER

(75) Inventor: Philip Derek Eduard De Haan, Zwaag (NL)

(73) Assignee: Alcons Audio B.V., Amsterdam (NL)

( * ) Notice: Subject to any disclaimer, the term of this patent is extended or adjusted under 35 U.S.C. 154(b) by 414 days.

(21) Appl. No.: 10/547,655

(22) PCT Filed: Mar. 3, 2004

(86) PCT No.: PCT/NL2004/000158
§ 371 (c)(1),
(2), (4) Date: Nov. 15, 2006

(87) PCT Pub. No.: WO2004/080120
PCT Pub. Date: Sep. 16, 2004

(65) Prior Publication Data

US 2007/0160233 A1 Jul. 12, 2007

(30) Foreign Application Priority Data

Mar. 3, 2003 (NL) ..... 1022820

(51) Int. Cl.
*H04R 1/00* (2006.01)

(52) U.S. Cl. ..... 381/431; 381/389; 381/340; 381/408

(58) Field of Classification Search ..... 381/397, 381/408, 152, 399, 431
See application file for complete search history.

(56) References Cited

U.S. PATENT DOCUMENTS

| | | | | |
|---|---|---|---|---|
| 3,209,084 | A * | 9/1965 | Gamzon et al. | 381/408 |
| 3,991,286 | A * | 11/1976 | Henricksen | 381/189 |
| 4,037,061 | A * | 7/1977 | von Recklinghausen | 381/408 |
| 4,264,789 | A | 4/1981 | Kaizu et al. | |
| 5,426,707 | A * | 6/1995 | Wijnker | 381/397 |
| 6,097,830 | A * | 8/2000 | Zelinka et al. | 381/431 |
| 6,104,825 | A * | 8/2000 | Thigpen | 381/408 |
| 6,111,970 | A | 8/2000 | Voishvillo et al. | |
| 7,020,301 | B2 * | 3/2006 | Koura et al. | 381/421 |
| 7,136,501 | B2 * | 11/2006 | Steere et al. | 381/399 |

* cited by examiner

*Primary Examiner* — Curtis Kuntz
*Assistant Examiner* — Ryan Robinson
(74) *Attorney, Agent, or Firm* — The Webb Law Firm

(57) ABSTRACT

A loudspeaker comprising a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, the frame being provided with metallic cooling members that partially cover the conductor pattern, wherein said cooling members are mounted in a metal housing, making contact with said housing over the larger part of their surface area, or are integral with such a metal housing.

19 Claims, 3 Drawing Sheets

LOUDSPEAKER

BACKGROUND OF THE INVENTION

The invention relates to a loudspeaker comprising a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, the frame being provided with metallic cooling members that partially cover the conductor pattern.

Such a loudspeaker is described in U.S. Pat. publication No. 4,264,789. The heat that is generated in the loudspeaker and the heating of the various loudspeaker parts that results therefrom causes the efficiency of the energy being supplied to decrease. By reducing the heating effect, the effective output of the loudspeaker will increase of. Known solutions for dissipating the heat of loudspeaker parts are ferro-fluid cooling, air cooling or convection. Metallic cooling members are used for dissipating the heat in said known loudspeaker.

The frame of said known loudspeaker comprises frame-shaped glass fibre/epoxy frame members, in which the membrane is mounted, and the metallic cooling members are two U-shaped metallic plates provided between one of the glass fibre/epoxy frame members and one side of the membrane, absorbing heat from the overlapping portion of the conductor pattern present on the other side of the membrane. The conductor pattern is an elongate, rectangular spiral, in which the parts covered by the metallic cooling members comprise the ends of said rectangle that do not contribute to the vibration of the membrane. Although no mention is made of this in said publication, it must be assumed that the assembly that is shown therein is enclosed in a loudspeaker housing. A limitation of said loudspeaker is the fact that the metallic cooling members only have a limited heat dissipating capacity.

SUMMARY OF THE INVENTION

The object of the invention is to provide a loudspeaker of the kind referred to in the introduction, which realises an improved heat dissipation in a simple and efficient manner and/or which exhibits improved mechanical and/or acoustic properties in comparison with known loudspeakers.

According to a first aspect of the invention, the cooling members are to that end mounted in a metal housing, making contact with said housing over the larger part of their surface area, or are integral with such a metal housing. The term housing as used herein is understood to mean a construction which envelopes the frame with the membrane and which is provided with at least one opening for transmitting the sound generated by the membrane, wherein said housing is, at least to a large extent, in direct contact with ambient air. Since a direct metal contact between the overlapping the membrane portion and the ambient air is created in this manner, the heat dissipation is significantly improved in comparison with the loudspeaker that is known from U.S. Pat. No. 4,264,789, in which the glass fibre/epoxy frame members, which have a low heat conduction coefficient, have a considerable impeding effect as regards the heat dissipation to the housing, and thus to the environment.

Preferably, the frame is made substantially entirely of a metal, it does not comprise any glass fibre/epoxy parts at all, as has been usual so far. In this way a solution which is strong as well as simple is provided.

The housing is preferably provided with outwardly extending cooling fins, which are mainly made of a metal. In this way a direct metal contact between the membrane and the environment is obtained via the cooling fins.

Furthermore, the housing is preferably provided with a sound horn, which is mainly made of a metal. In this way the sound horn contributes to the heat dissipation.

The conductor pattern preferably comprises substantially parallel lines, which extend substantially in an elongate rectangle, with the cooling members covering at least one end, preferably both ends, of the rectangle. Said ends do not contribute to the sound production, but they do contribute to the heat production, and, in addition, the heat of the parts that do produce sound is dissipated via said ends.

Preferably, at least one of the ends, preferably both ends, of the rectangle are covered by the cooling members on both sides of the membrane. This increases the heat dissipating capacity. The conductor pattern and the cooling members provided thereon are preferably electrically separated by a thin, electrically insulating adhesive layer, such as a glue or a tape. Preferably, said glue is a heat-conducting glue.

In order to contribute further to the cooling action, the loudspeaker may be provided with a fan and/or with other active cooling means.

The metal of at least the cooling members preferably has a high heat conduction coefficient, preferably it is copper or aluminium. The advantage of (anodised) aluminium is that it has an electrically insulating layer of itself, so that electric contact with the conductor pattern is prevented.

According to a second aspect of the invention, which may or may not be implemented in combination with the aforesaid preferred characteristics, the aforesaid objects are achieved in that the cooling members are mounted directly on the conductor pattern by means of a thin, electrically insulating adhesive layer , such as a glue or a tape. This leads to an improved heat transfer from the conductor to the environment in comparison with the mounting of the cooling members on the other side of the membrane as shown in U.S. Pat. No. 4,264,789.

BRIEF DESCRIPTION OF THE DRAWINGS

The invention will now be explained in more detail by means of an embodiment as shown in the figures, in which.

DETAILED DESCRIPTION OF THE INVENTION

Figure 1:
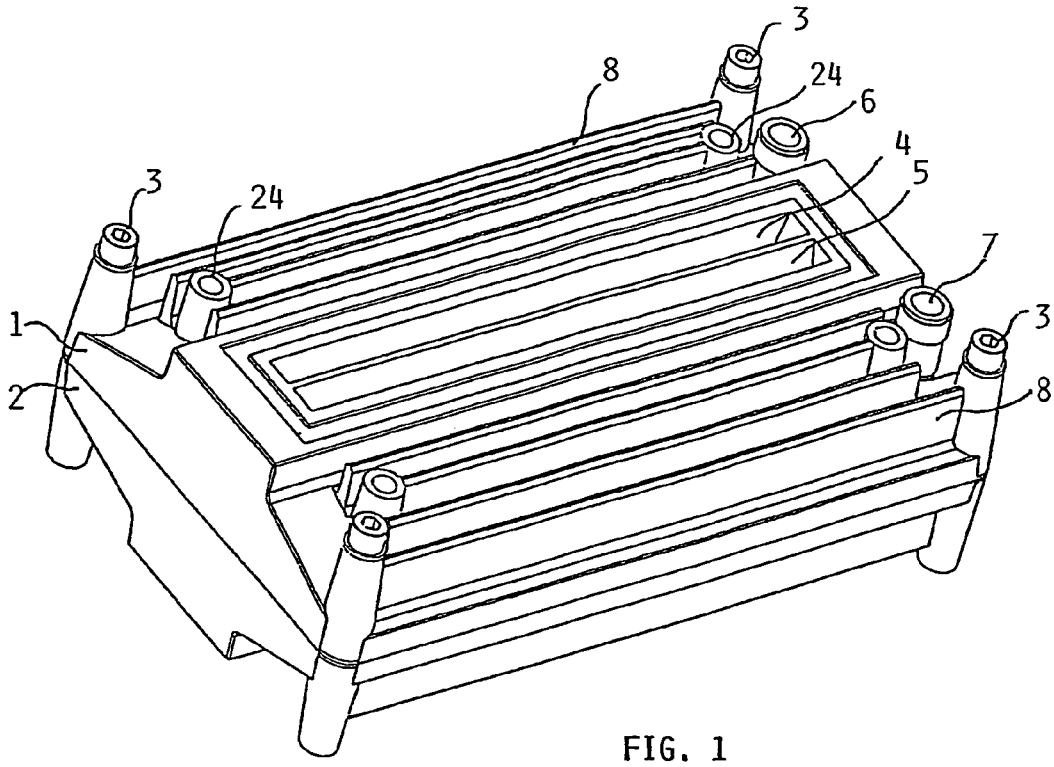
FIG. 1 is a partial perspective view of a loudspeaker.

According to FIG. 1, a loudspeaker comprises a housing which consists of two substantially identical metal parts 1, 2, which are mounted together by means of screws 3. Each housing part 1, 2 has two elongate slot-shaped recesses or sound channels 4, 5, which enable the sound that is generated in the loudspeaker to propagate towards the outside. Furthermore, a housing part 1 is provided with electrical connecting points 6, 7, to which the sound signal wires of an amplifier can be connected. The housing 1, 2 is provided with cooling fins 8 for dissipating the heat that is generated in the loudspeaker.

Figure 2:
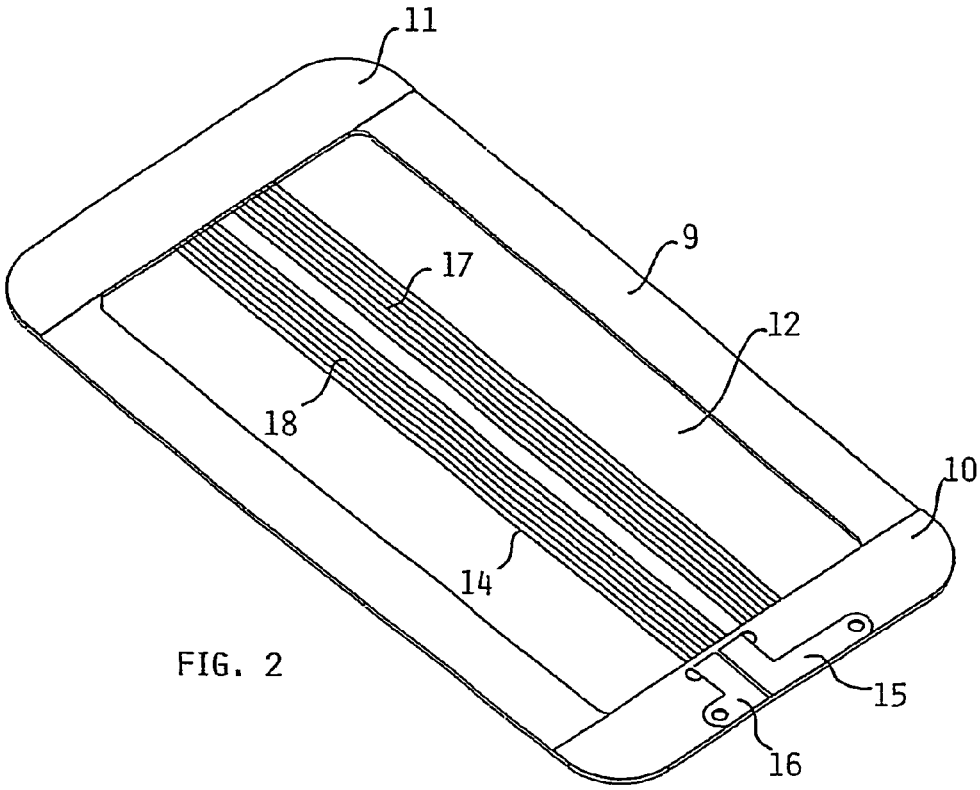
FIG. 2 is a perspective view of a membrane unit.
Figure 3:
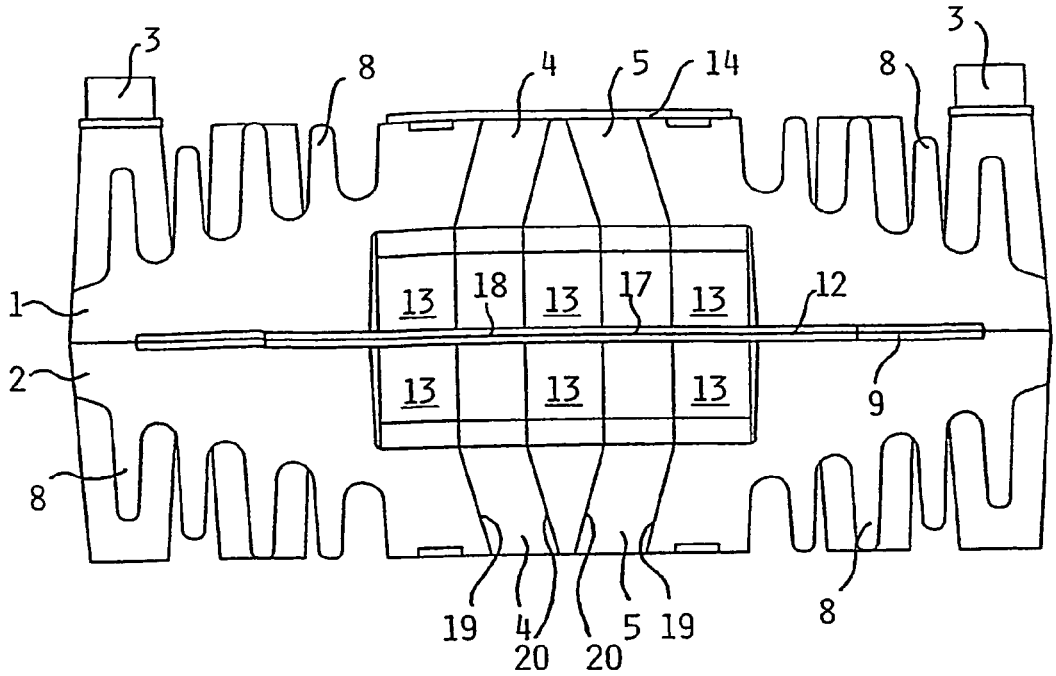
FIG. 3 is a cross-sectional view of the loudspeaker of FIG. 1.
Figure 5:
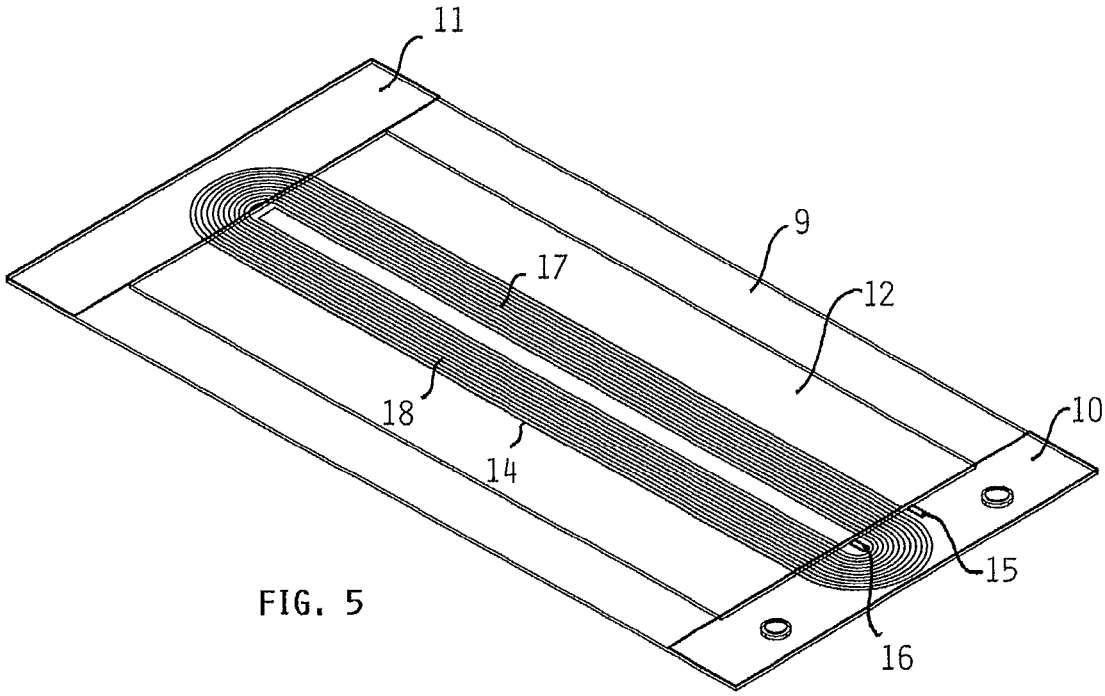
FIG. 5 is a perspective view of a membrane unit, showing a conductor pattern under frame members.

The housing parts 1, 2 enclose a frame that is shown in FIG. 3, which consists of a first, frame-shaped frame member 9 and two strip-shaped frame members 10, 11 (shown in FIGS. 2 and 5). The frame members 9, 10, 11 are preferably made of copper or anodised aluminium. The outer surface of the frame members 9, 10, 11 makes contact with the housing 1, 2 all around. A vibrating membrane 12 is affixed to the frame member 9 by means of a glue, or by means of a thin, double-coated adhesive tape. The glue or the tape is of a heat-conducting type. The membrane 12 is provided with an electric conductor pattern 13, which is connected to the connecting points 6, 7 and which causes the membrane to vibrate when an electrical signal is supplied to the loudspeaker by the amplifier.

To that end the loudspeaker comprises magnets 13 as shown in FIG. 3, which generate a permanent magnetic field within which the conductor pattern 14 of the membrane 12 is located. The conductor pattern 14 is formed by an electrically conducting wire arranged in an elongate, rectangular spiral on one side of the membrane 12. On the short sides of the rectangular pattern, the frame members 10, 11 are mounted directly on the conductor pattern. The glue or the tape by means of which said frame members are affixed to the conducting wire must be electrically insulating, therefore. On the other side of the membrane 12, said short sides of the pattern are likewise covered, in this case by the short sides of the frame-shaped frame member 9. In this way the conductor pattern 14 is capable of transferring heat to the frame members 9, 10, 11 in two directions.

The two ends of the conducting wire are connected to current feed-through connections 15, 16 on the frame member 10, which are in turn electrically connected to the connecting points 6, 7. The current feed-through connections 15, 16 are electrically insulated from the frame member 10. The lines of the conductor pattern 14 that extend parallel to each other in the longitudinal direction between the frame members 10, 11 form two spaced-apart vibrating regions 17, 18.

Referring to FIG. 3, the sound channels 4, 5 extend from a point located near the two spaced-apart vibrating regions 17, 18 on the surface of the membrane 12 to the outer side of the housing parts 1, 2; on one side the sound channels 4, 5 are closed by a closing plate, however, because the loudspeaker must emit the sound in only one direction. The sound channels 4, 5 initially extend in a direction perpendicularly to the membrane, seen from the membrane, viz. in the region between the magnets 13, and subsequently the sound channels 4, 5 incline towards each other. Both the outer walls 19 and the inner walls 20 of each sound channel 4, 5 incline towards each other, with the inner wall 19 and the outer wall 20 of a sound channels 4, 5 continuing to extend parallel to each other. On the outer side of the loudspeaker, only a small spacing remains between the inner walls 19 of the two sound channels 4, 5, which spacing is at least several times smaller than the spacing between the vibrating regions 17, 18. In this way the fronts of the sound waves that are generated by the two vibrating regions 17, 18 are directed towards each other and combined, so that disadvantageous interference between the two wavefronts is prevented.

Figure 4:
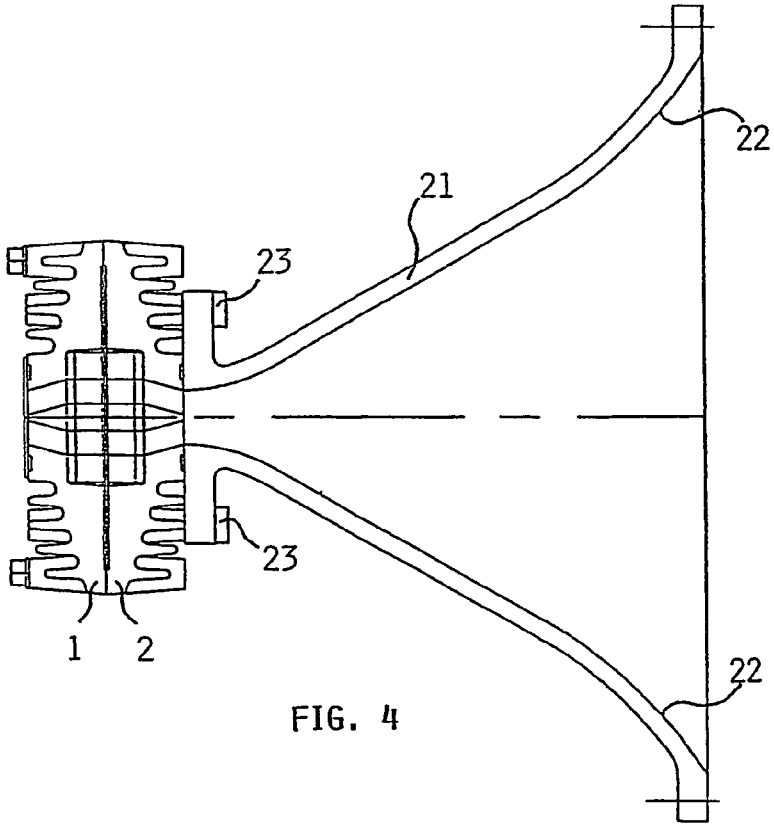
FIG. 4 is a cross-sectional view of the loudspeaker of FIG. 1, on which a sound horn is mounted.

FIG. 4 shows a sound horn 21 which is mounted in screw holes 24 of the loudspeaker by means of screws 23. The outer walls 19 of the sound channels 4, 5 join the walls 22 of the sound horn 21. The sound horn 21 provides a gradual widening of the sound front that exits the sound channels 4, 5 before said sound front widens further in the environment. The horn, which is made of a metal, furthermore contributes to the heat dissipation of the loudspeaker.

The invention claimed is:

1. A loudspeaker comprising a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, wherein said conductor pattern is comprised of a multitude of substantially parallel electrically conducting lines extending substantially in an elongated rectangle and a multitude of electrically conducting lines connecting said parallel lines at the short sides of said rectangle, said parallel lines and connecting lines together defining said electrical conductor, the frame being provided with metallic members that cover all lines of said conductor pattern that are not parallel to a length of said membrane on at least one short side of said rectangle, wherein the metallic members are mounted in a metal housing, making contact with said housing over the larger part of their surface area, or are integral with said housing, such that in use heat produced in each one of said multitude of electrically conducting lines is dissipated to said metal housing via said connecting lines.

2. The loudspeaker according to claim 1, wherein the frame is made substantially entirely of a metal.

3. The loudspeaker according to claim 1, wherein the housing is provided with outwardly extending cooling fins, which are mainly made of a metal.

4. The loudspeaker according to claim 1, wherein the housing is provided with a sound horn, which is mainly made of a metal.

5. The loudspeaker according to claim 1, wherein the metallic members cover both ends of the rectangle.

6. The loudspeaker according to claim 1, wherein at least one of the ends of the rectangle is covered by the metallic members on both sides of the membrane.

7. The loudspeaker according to claim 1, wherein the conductor pattern and the metallic members provided thereon are electrically separated by a thin, electrically insulating adhesive layer, such as a glue or a tape.

8. The loudspeaker according to claim 7, wherein the glue is a heat-conducting glue.

9. The loudspeaker according to claim 1, wherein the loudspeaker is provided with a fan and/or with other active cooling means.

10. The loudspeaker according to claim 1, wherein the metal of at least the metallic members is made of copper or aluminum.

11. A loudspeaker comprising a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, wherein said conductor pattern is comprised of a multitude of substantially parallel electrically conducting lines extending substantially in an elongated rectangle and a multitude of electrically conducting lines connecting said parallel lines at the short sides of said rectangle, said parallel lines and connecting lines together defining said electrical conductor, the frame being provided with metallic members that cover all lines of said conductor pattern that are not parallel to a length of said membrane on at least one short side of said rectangle, wherein the metallic members are mounted directly on the conductor pattern by means of a thin, electrically insulating adhesive layer, such as a glue or a tape, such that in use heat produced in each one of said multitude of electrically conducting lines is dissipated to said metal housing via said connecting lines.

12. The loudspeaker according to claim 11, wherein the frame is made substantially entirely of a metal.

13. The loudspeaker according to claim 11, wherein the housing is provided with outwardly extending cooling fins, which are mainly made of a metal.

14. The loudspeaker according to claim 11, wherein the housing is provided with a sound horn, which is mainly made of a metal.

15. The loudspeaker according to claim 11, wherein the metallic members cover both ends of the rectangle.

16. The loudspeaker according to claim 11, wherein at least one of the ends of the rectangle is covered by the metallic members on both sides of the membrane.

17. The loudspeaker according to claim 11, wherein the glue is a heat-conducting glue.

18. The loudspeaker according to claim 11, wherein the loudspeaker is provided with a fan and/or with other active cooling means.

19. The loudspeaker according to claim 11, wherein the metal of at least the metallic members is made of copper or aluminum.

* * * * *